US008007451B2

(12) United States Patent
Håvardsholm et al.

(10) Patent No.: US 8,007,451 B2
(45) Date of Patent: Aug. 30, 2011

(54) SERVO MOTOR FOR CPR WITH DECOMPRESSION STROKE FASTER THAN THE COMPRESSION STROKE

(75) Inventors: Jostein Håvardsholm, Stavanger (NO); Helge Fossan, Stavanger (NO); Øystein Strømsnes, Tau (NO)

(73) Assignee: Laerdal Medical AS, Stavanger (NO)

( * ) Notice: Subject to any disclaimer, the term of this patent is extended or adjusted under 35 U.S.C. 154(b) by 917 days.

(21) Appl. No.: 11/603,976

(22) Filed: Nov. 21, 2006

(65) Prior Publication Data

US 2008/0119766 A1 May 22, 2008

Related U.S. Application Data

(60) Provisional application No. 60/746,993, filed on May 11, 2006.

(51) Int. Cl.
*A61H 31/00* (2006.01)

(52) U.S. Cl. ..... 601/41; 601/44; 601/DIG. 8

(58) Field of Classification Search ..... 601/41–44, 601/148–152, 107, 108; 600/16, 17
See application file for complete search history.

(56) References Cited

U.S. PATENT DOCUMENTS

| | | | | |
|---|---|---|---|---|
| 3,489,140 | A * | 1/1970 | Mullikin | 601/97 |
| 4,359,312 | A * | 11/1982 | Funke et al. | 417/18 |
| 4,632,094 | A | 12/1986 | Thomas | 128/52 |
| 4,770,164 | A * | 9/1988 | Lach et al. | 601/41 |
| 5,287,846 | A * | 2/1994 | Capjon et al. | 601/44 |
| 6,066,106 | A | 5/2000 | Sherman et al. | 601/41 |
| 6,290,660 | B1 | 9/2001 | Epps et al. | 601/41 |
| 7,056,295 | B2 * | 6/2006 | Halperin | 601/41 |
| 7,226,427 | B2 * | 6/2007 | Steen | 601/44 |
| 2005/0054958 | A1 | 3/2005 | Hoffmann | 601/46 |
| 2005/0165335 | A1 | 7/2005 | Sherman et al. | 601/44 |
| 2006/0094991 | A1 | 5/2006 | Walker | 601/41 |
| 2008/0086062 | A1 * | 4/2008 | Hansen et al. | 601/44 |

FOREIGN PATENT DOCUMENTS

| | | |
|---|---|---|
| NO | 317474 | 1/2001 |
| WO | WO 90/05518 | 5/1990 |
| WO | WO 00/27334 | 5/2000 |
| WO | WO 2004/058136 | 7/2004 |
| WO | WO 2006/039166 | 4/2006 |

* cited by examiner

*Primary Examiner* — Danton DeMille

(74) *Attorney, Agent, or Firm* — Dorsey & Whitney, LLP

(57) ABSTRACT

The invention regards a resuscitation system having a chest compression device to repeatedly compress the chest of a patient and thereafter cause or allow the chest to expand. The device includes an electric motor connected to a compression element. A controller is coupled to the electric motor and causes the motor to actuate the compression element according to a predetermined profile. The controller is further operable to draw the compression element away from a patient's chest upon detecting a malfunction.

31 Claims, 4 Drawing Sheets

SERVO MOTOR FOR CPR WITH DECOMPRESSION STROKE FASTER THAN THE COMPRESSION STROKE

CROSS-REFERENCE TO RELATED APPLICATION

This application claims the benefit of U.S. Provisional Patent Application No. 60/746,993, filed May 11, 2006.

The entire disclosure of the prior application is considered to be part of the disclosure of the instant application and is hereby incorporated by reference therein.

TECHNICAL FIELD

The invention relates generally to apparatus for treating cardiac arrest and, more specifically, chest compression devices.

BACKGROUND OF THE INVENTION

Sudden cardiac arrest is a leading cause of death in developed countries in the Western World, like United States and Canada. To increase the chance for survival from cardiac arrest, important aspects are CPR (Cardio Pulmonary Resuscitation) and heart defibrillation given in the first few critical minutes after the incident. CPR is performed to ensure a sufficient flow of oxygenated blood to vital organs by external compression of the chest combined with rescue breathing. Heart defibrillation is performed to re-establish normal heart rhythm by delivery of external electric shock.

The quality of CPR is essential for survival. Chest compressions must be given with a minimum of interruptions, and be of sufficient depth and rate. Manually performed chest compressions is an extremely exhausting task, and it is practically impossible to give sufficient quality manual CPR during transportation of a patient.

Many different types of automatic chest compression devices have been developed to overcome this, based on a wide variety of technical solutions. Some devices comprise a piston which presses the patient's chest down with a given frequency and a given force. These devices comprise hydraulic/pneumatic mechanisms to provide a reciprocating movement for the piston. Other devices comprise a belt embracing the chest and a rotating motor with a spindle being engaged and disengaged.

Chest compressions given by automatic devices have the potential to be more forceful than manual compressions. There is a balance between 1) giving optimal blood flow to vital organs and 2) limiting the impact to the chest, to avoid internal injuries as a result of the external force being applied to the patient. Previously known automatic chest compression devices are designed mainly with respect to 1), and in many cases do not provide a satisfactory balance between 1) and 2).

SUMMARY OF THE INVENTION

The invention comprises a chest compression device that permits control of the compression characteristics. In some embodiments, this is achieved by providing the device with an electric motor and a controller. Such embodiments may also comprise a transmission mechanism for transferring mechanical energy between the motor and a compression element. Other advantageous features of the invention are mentioned in the appended claims.

In some embodiments, a satisfactory quality for chest compressions (frequency, speed and force) has been achieved using motors that are able to accelerate very rapidly and at the same time are able to provide high power in short periods of time. These requirements may be fulfilled by servo motors. In some embodiments, the servo motors have low rotational inertia and are adapted for high peak power.

In some embodiments, control of the motor is performed by a controller. Use of an electric motor with a controller enables full control of compression with respect to most or all of important factors, such as compression depth, compression force, compression frequency, duration of compressions, rate of relieving and applying pressure, etc. In some embodiments, control of these factors is performed by controlling the waveform of the compressions.

By having control of the compression waveform as applied to the patient, it is possible to achieve an improved balance for each patient/recipient and for each stage in the treatment. In this way the pulse pattern of the compression/decompression can be adapted to the individual patient at different stages in treatment, thus leading to improved therapy concerning both blood flow and avoidance of internal injuries.

The controller may further provide the ability to extract and log chest compression data from the system controller, enabling clinical studies and optimization of the system. Internal injuries could be related to for instance the depth profile of the compression piston, etc. Logging data would enable research into this topic and others.

BRIEF DESCRIPTION OF THE DRAWINGS

The invention will now be described by means of examples illustrated in the drawings, wherein.

DETAILED DESCRIPTION OF PREFERRED EMBODIMENTS

Figure 1:
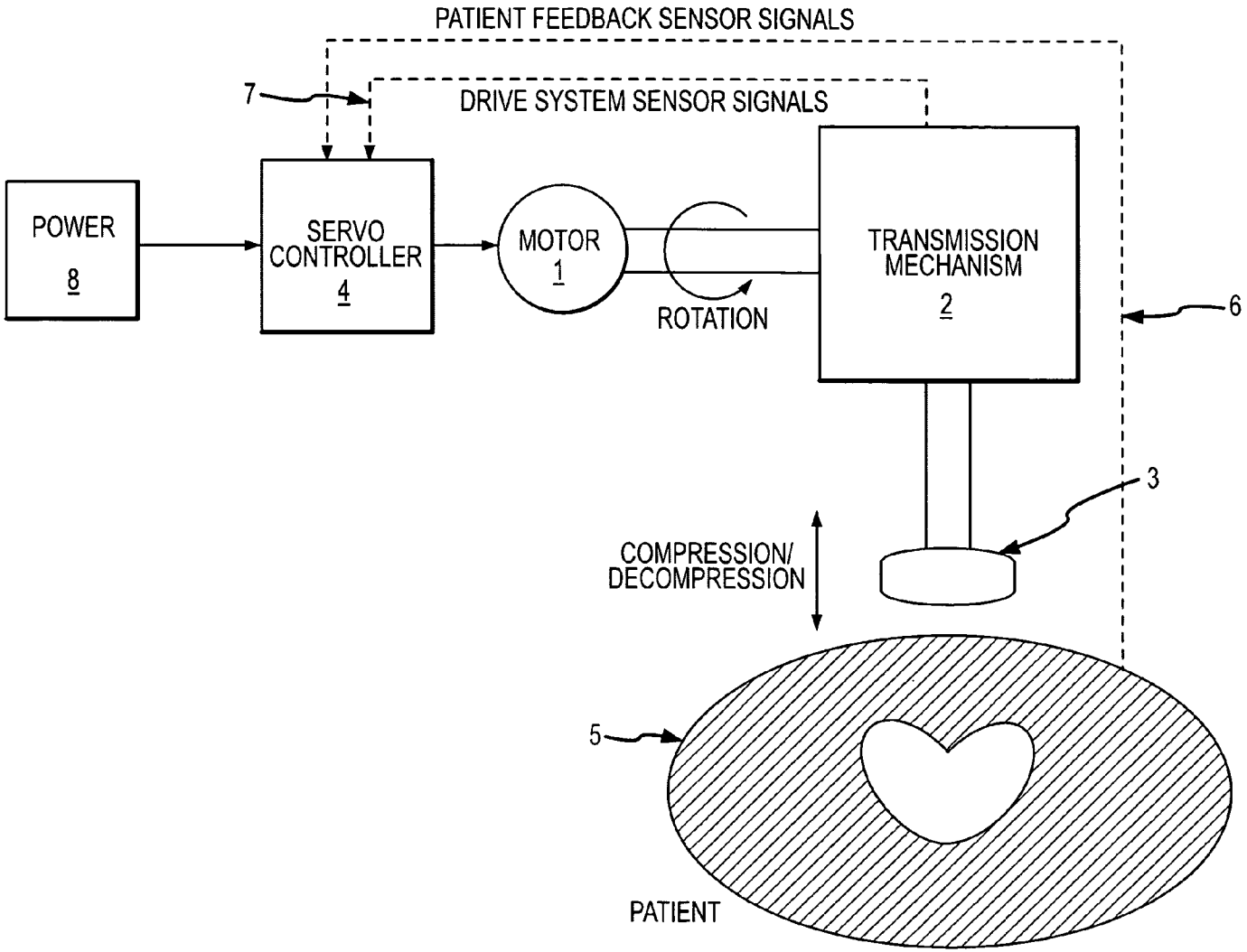
FIG. 1 is a block diagram of a chest compression device according to an embodiment of the present invention.

FIG. 1 shows a block diagram of an embodiment of a chest compression providing compressions to a patient in a controlled manner. The device comprises a servo motor 1 connected to a transmission mechanism 2 for transforming rotational movement in the motor 1 into a reciprocating movement. The transmission mechanism 2 is connected to a compression element 3, which can, for example, be formed as a plate, a vacuum cup, or a round shaped body. The compression element 3 is driven by the motor 1 to perform compressions. The device may also comprise a servo controller 4, which among other functions controls the motor's operating cycle. The servo controller 4 is adapted to drive the motor 1 with any digital modulated pulse pattern. As shown in the figure, there may be provided feedback signals 6 from the patient 5 to the servo controller 4. It is also possible to provide control signals 7 related to the transmission mechanism 2 as feedback for motor control. The device also comprises a power source 8.

As mentioned previously, the motor 1 may advantageously fulfill certain requirements regarding: a) kinetic energy at max speed, b) peak power, c) efficiency (at a given power), d) weight and dimensions.

Limited kinetic energy provides dynamic performance that is, the ability to freely select a displacement profile for the compression element without high power consumption. Limited kinetic energy also provides improved safety if there is a fault in the electrical power system causing all the kinetic energy to be released into the patient's chest. In some embodiments, the limit for the kinetic energy of the motor is about 4 J (breast stiffness 200N×displacement 0.02 m=4 J).

In one example, peak power, with for example a maximum force of 550N transferred to a patient and a maximum retraction speed for the compressing element of 0.63 m/s is: P=550N×0.63 m/s=347 W. This is the power necessary, in one embodiment, at the patient's end, and losses in the transmission mechanism may advantageously be taken into consideration. This leads to a peak power for the motor in one embodiment of the invention of 400 W-600 W.

In one embodiment of the invention, substantially free return of the patient's chest to a non-compressed position is permitted by retracting the compressing element at high speed (e.g. 0.63 m/s). In another embodiment a substantially free return of the chest to an uncompressed position is permitted by means of the transmission mechanism (e.g. by mechanically disconnecting the motor from the compression element). Where the transmission mechanism is disconnected to permit return of the chest, the maximum return speed requirement may be ignored and a motor with a peak power of. 300 W-500 W has been found to be adequate.

High efficiency leads to long battery life and little generation of heat. In one embodiment of the invention, motor 1 has an efficiency of about 75%, however motors with other efficiencies may also be used.

Weight and dimensions are limited in an embodiment of the device adapted for portable use. In said embodiment the motor's weight may be limited to 500 grams.

Other relevant parameters of the motor may include average power, voltage (insulation strength), motor constants (rpm/V, etc), durability, radial and axial load on bearing. Average power may be controlled to avoid overheating a motor. In one embodiment of the invention the motor 1 has an average power greater than 100 W.

Motor 1 can e.g. be a brushless DC motor (for example a motor with a peak power equal or higher than 400 W and efficiency higher than 75%, or, for example, a motor with a peak rating up to 500 W and 150 W average rating, such as a brushless Minebae 40S40A) or it can be a DC motor with brushes. If transistors provide the commutation, any variant or combination of block commutation or sinusoidal commutation might be used. Motor 1 may comprise a controller structure with feed forward.

Figure 2:
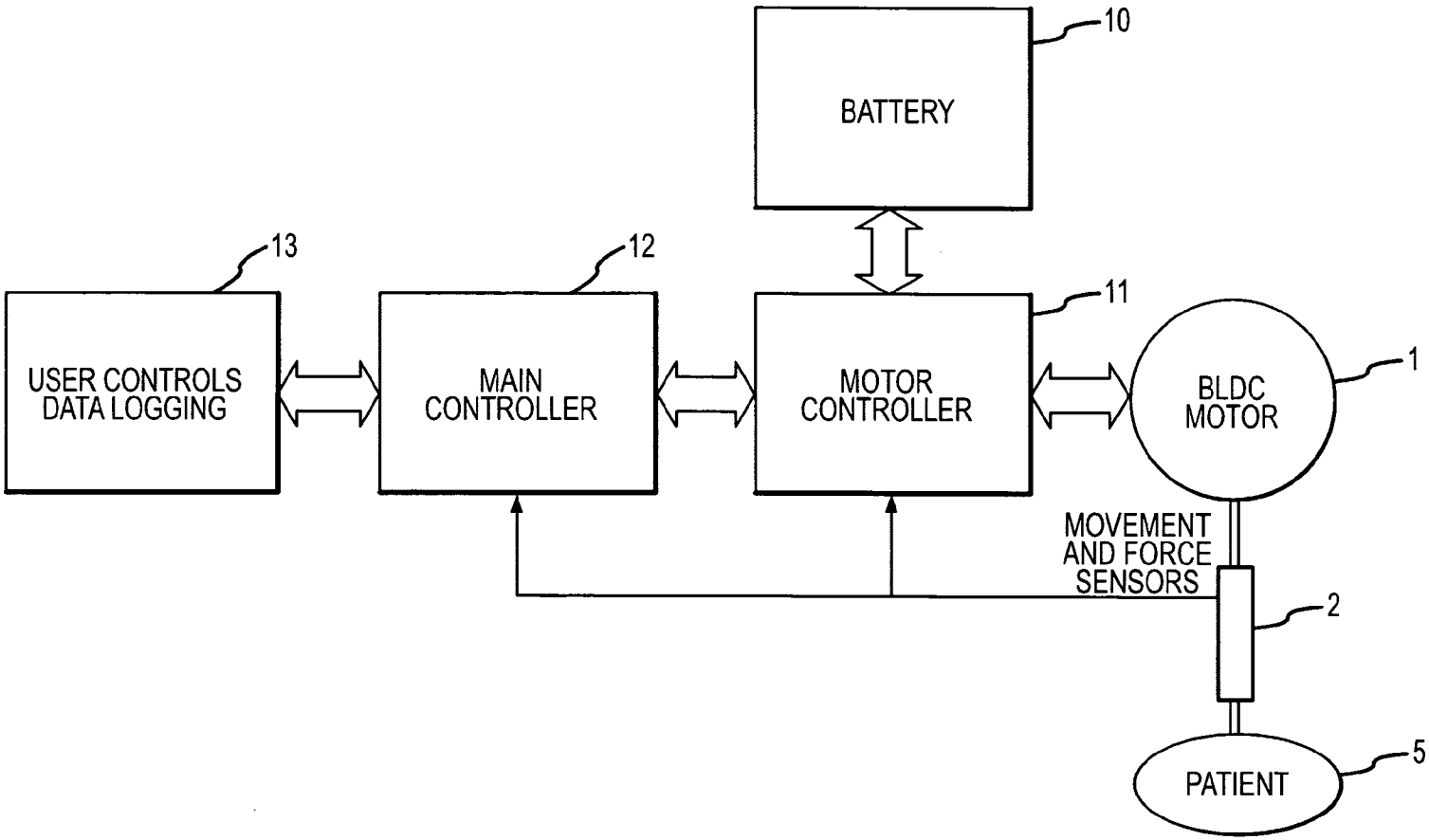
FIG. 2 is a more detailed block diagram of an embodiment of the device according to an embodiment of the present invention.

FIG. 2 shows a more detailed block diagram of the device according to an embodiment of the invention. This diagram shows controller 4 comprising three elements: a motor controller 11, a main controller 12, user controls and data logging 13. This division is done purely for illustration purposes as the three elements can be integrated in a single device, or any two elements can be integrated while one element is provided separately. Motor controller 11 has as a function to sense the motor rotational position and to control operation of the motor and also the motor's connection to the battery 10. Main controller 12 can receive signals from different sensors and provide feedback signals to control the device. Main controller 12 is also able to receive signals not generated by the device itself, as e.g. user controls, patient feedback data and output values of signals providing data logging.

Figure 3:
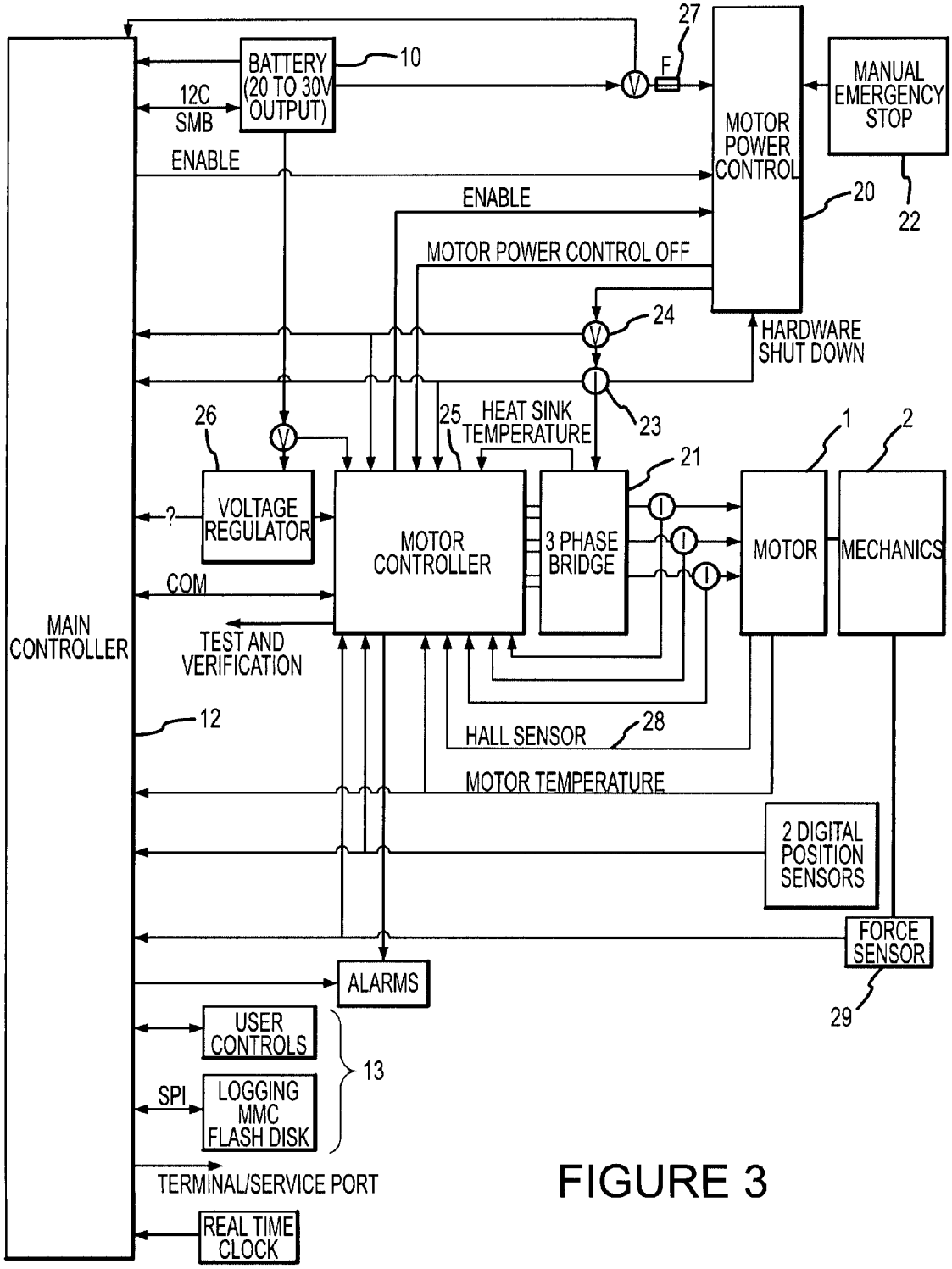
FIG. 3 is a more detailed block diagram of an embodiment of the device according to an embodiment of the present invention.

FIG. 3 is a more detailed block diagram of one embodiment of the device according to the invention. The embodiment of FIG. 3 includes a power source equipped with a battery 10 for providing power to the motor 1 via a three phase bridge 21. The battery 10 has, in one embodiment of the invention (shown in FIG. 4), a capacity of 2.3 Ah, is able to deliver more than 600 W of peak effect, and has an inner resistance lower than 0.3Ω. In portable versions of the device, the battery may have a weight of less than 1 kg and a volume of approximately 200 mm×80 mm×80 mm. The battery preferably does not overheat when it delivers an average power of 150 W at an ambient temperature of 40 degrees Celsius. These criteria are met, for example, by high power lithium ion cells such as ANR26650MI available from A123 Systems Inc, or by other batteries capable of delivering energy directly to the motor (that is, without intermediate energy storage).

Intermediate storage of energy may advantageously be provided in embodiments of the device which comprise batteries not complying with the above mentioned criteria, energy storage in capacitors may help to acheive the 600 W peak power requirement. If boost circuitry is used to achieve a substantially constant battery current during the compression cycle, the battery heat dissipation can be reduced and batteries with less power handling capability than the A123 system may be used.

Another possibility (not shown) is to provide a power source adapted for connection to AC or DC mains with a small 100 W power supply if the high power lithium ion battery (or batteries) is connected in parallel with the supply. The battery will provide the peak power needed for the device operation while the power supply will ensure that the battery does not discharge. Using batteries in stead of capacitors as an energy storage will ensure that the device operation is not interrupted if the power supply is disconnected for a short period when moving the patient from one room to another etc. In one embodiment of this invention capacitors are used instead of batteries.

A combination of the above mentioned embodiments is also possible.

A motor power control circuit may be activated in case of an error situation. The circuit may cut the supply to the motor e.g. by opening the battery high side connection to the bridge circuitry. The motor power control 20 may be activated by: a) a motor controller circuit 25, b) manually (emergency stop 22), c) the main controller 12, d) a low battery voltage signal, e) low/high regulated 5V and 3.3V (not shown), and/or d) hardware shutdown as a consequence of high peak current. If the motor controller 25 fails and the bridge current rises, the main controller 12 may initiate a shut down. A hardware solution may be used if faster shutdown is needed. Some embodiments of the invention can comprise only one or a selected group of the above mentioned activating inputs. In one embodiment, substantially all input lines to the motor power control 20 have to be activated in order for the switch to turn "on" and allow compressions of the patient.

As mentioned above, in one embodiment, the battery 10 delivers power to the motor 1 via the motor power controller 20 and the three phase bridge 21. The bridge circuit 21 can have an energy storage capacitor (not shown) which may aid compression element return in an error mode. The bridge 21 comprises high side transistors (not shown) which preferably run at 100% duty cycle in order to achieve block commutation of the motor 1. In one embodiment of the invention battery voltage is limited to 30V and the bridge can comprise mosfets with a breakdown voltage of 60V.

The motor controller circuit 25 drives the motor in accordance with a drive profile, that is a determined sequence of digitally modulated pulses with a determined shape. Circuit 25 will encompass all the necessary drive algorithms needed.

FIG. 3 shows many inputs to controller 25, and some of these may be omitted in some embodiments. Some of the possible inputs include:

a) Hall elements 28 for indication of the position of the motor rotor and thus the compression element's position, b) Two absolute position indicators corresponding to monitoring of the position of the compression element with respect to two limits: a bottom position (full compression) and a high position (no compression). The position limit interval at the bottom may preferably be regarded as an absolute stop position, such that movement beyond this position is very small. The top position may be used for resetting a Hall sensor signal count. Counting Hall sensor pulses from this position may provide information relating to the piston position. A middle position is used for checking the mechanical movement during operation, c) Force (29) analog input, d) motor current monitoring, e) battery output current and voltage monitoring, f) Input power from regulator, g) Input from main controller 12, activating compression element movement, h) Input from motor power control circuitry 20, and i) motor temperature measurement.

Outputs from the controller 25 may include:

a) Power off signal to motor power control 20, b) outputs for test and verification, c) Bridge gate signals for mosfets 21, d) Charge pump switch signal to enable the drive voltage for the top mosfets (not shown), and e) Signals to the alarm circuits.

The motor controller may comprise software for performing the following tasks:

1) Communication and control between the main controller 12 and the motor controller 25. For example, the main controller can download a "drive profile" to the motor controller 25 prior to activation of device movement. The drive profile encompasses desired depth waveforms with respect to time and force limitations, 2) communicating relevant status/measurement data obtained by the motor controller 25. The communication protocol is preferably designed to detect deviations from normal functionality, 3) Identify erroneous movement or lack of movement of the device, overheating. The motor controller may deactivates the motor power control 20 in order to safeguard the "patient". The software must preferably also responds to overheating of the motor and the drive electronics, 4) Preferably both processors 12 and 25 can shut down the system, and initiate alarms.

Motor controller 25 controls operation of motor 1 by controlling operation of the three phase bridge 21. As a safety measure, the device may be adapted to proceed in such a way that if battery 10 is suddenly removed, the main controller 12 notices the removal and immediately initiates a controlled shut down.

Safe termination of operation may be limited to turning off bridge 21 thus allowing the compression element 3 (FIGS. 1 and 2) to return using the chest force to push the piston to the top position. In an alternative embodiment a controlled return to high compression element position is used.

During start up the main processor 12 preferably controls all the device's parts. When the system is "good to go" a signal will be given to the motor controller 25. The software may comprise drive algorithms in order to safely drive the motor/device in various states of operation, illustrated in FIG. 4, which include:

A) Start position: the compression element is kept close to the upper compression position when mounting the machine on the patient, B) Upper compression position: the compression element can be kept in position by the force from the patient's chest, C) Movement down according to depth profile, D) Transition from a limited force to a maximum force, E) Hold at accurate depth, F) Return to Upper position.

Figure 4:
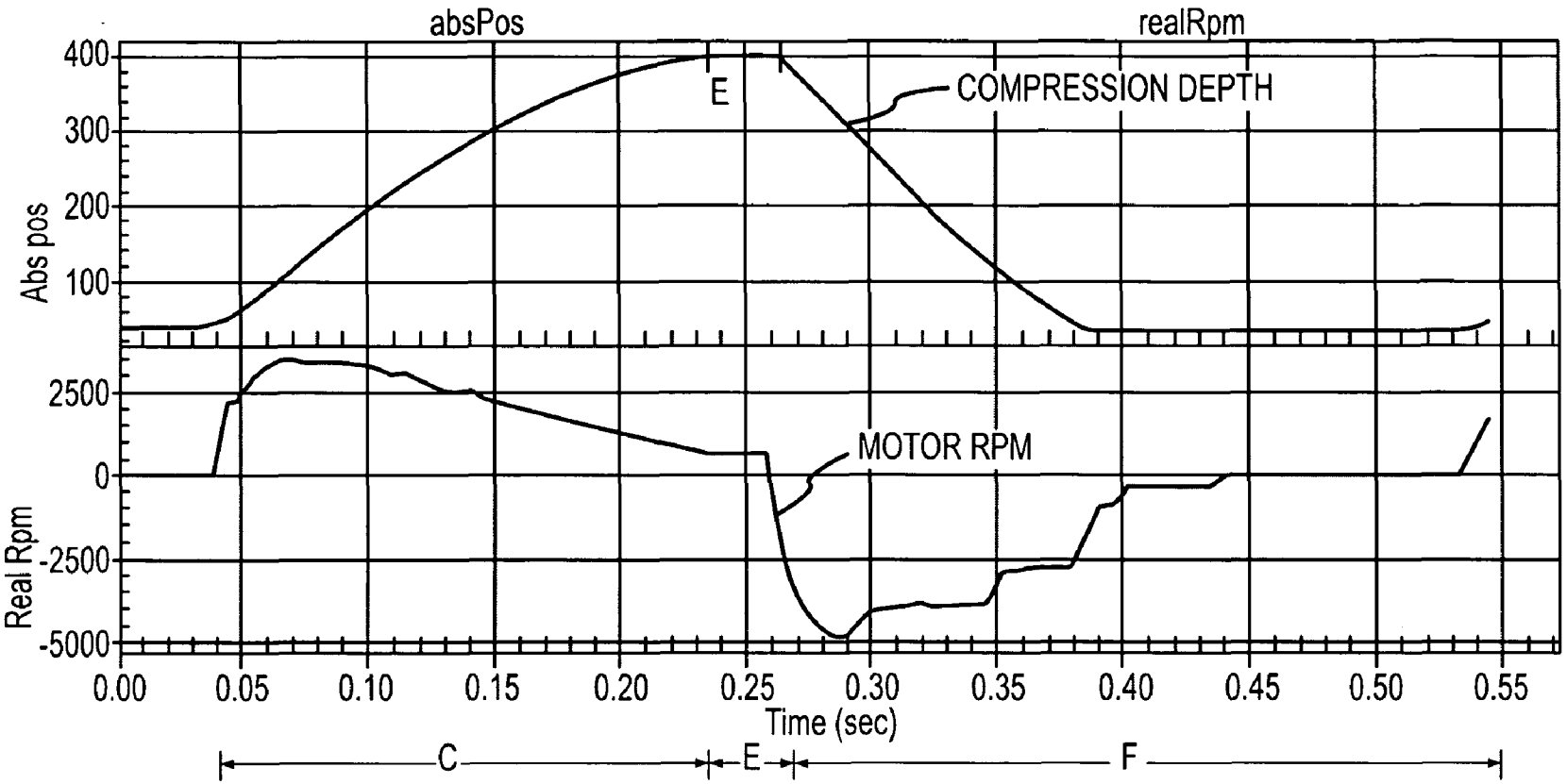
FIG. 4 is a graph showing an example of compression depth and motor velocity vs. time according to an embodiment of the present invention.

FIG. 4 shows two curves. The upper curve shows inverted compression depth vs. time, where the value of compression depth is multiplied by 0.125 (400=50 mm). The lower curve shows the motor RPM, where the maximum speed at compression is limited to 3500 RPM in order to avoid chest injuries while the decompression is done at a higher speed (−5000 RPM) in order to increase the patient's blood flow. In one embodiment of the invention, the motor speed during decompression is between 1.2 and 1.6 times the motor speed during compression. In a preferred embodiment, the motor speed during decompression is about 1.4 times that of the motor during compression. As one can see from the lower curve, the motor is accelerated at the beginning of a compression cycle and thereafter it experiences a reduction in velocity until the lowest compression point is reached. After a short interval with constant speed (maximum compression), a high acceleration period follows to allow the chest to decompress naturally. The waveform shown in this figure is only meant for illustrative purposes as the invention permits use of any waveform in the compression process. In some embodiments, linear motors may be used, in which case the curves of FIG. 4 may describe the linear speed of the motor, rather than RPM. Where a linear motor is used, the curves of FIG. 4 may have a similar shape but be scaled larger or smaller.

As one can see the device according to the invention permits performance of controlled, swift and effective CPR. The use of an electric motor permits also easy adaption of the compression parameters to different patients and different situations.

What is claimed is:

1. A method for performing chest compression comprising:

performing a compression stroke urging a compression element against a patient's chest according to a non-sinusoidal drive profile stored in a controller operably coupled to the compression element;

performing a decompression stroke drawing the compression element away from the patient's chest according to the non-sinusoidal drive profile, the compression element moving at a greater maximum velocity during the decompression stroke;

waiting for a delay period according to the drive profile; and repeating the compression stroke, decompression stroke, and delay period.

2. The method of claim 1, wherein the maximum speed of the compression element in the decompression stroke is between about 1.2 and about 1.6 times the maximum speed of the compression element in the compression stroke.

3. The method of claim 2, wherein the maximum speed of the compression element in the decompression stroke is about 1.4 times the maximum speed of the compression element in the compression stroke.

4. The method of claim 1, wherein the compression stroke comprises an acceleration period and a deceleration period, the deceleration period being substantially longer than the acceleration period.

5. The method of claim 1, further comprising moving the compression element at constant velocity between the compression and decompression strokes.

6. The method of claim 1, further comprising interrupting the compression stroke and drawing the compression element away from the patient's chest upon detecting an unsafe condition.

7. The method of claim 1, further comprising storing energy in a energy storage device adjacent the compression element and drawing energy from the energy storage device to draw the compression element away from the patient's chest upon detecting an unsafe condition.

8. The method of claim 7, wherein the unsafe condition is failure of an external power supply.

9. A chest compression device comprising:

a compression element;

a power source;

an electric motor coupled to the compression element and operable to actuate the compression element;

a controller coupled to the electric motor and the power source to regulate the speed of the motor, the controller programmed to cause the electric motor to actuate the compression element according to a periodic non-sinusoidal drive profile, the drive profile including a compression portion in which the electric motor drives the compression element to compress a patient's chest, a decompression portion in which the electric motor drives the compression element away from the patient's chest to allow the chest to decompress, and a wait portion; and wherein the decompression portion has a maximum motor speed substantially greater than a maximum motor speed of the compression portion.

10. The chest compression device of claim 9, wherein the motor is a low inertia servo motor.

11. The chest compression device of claim 9, wherein the motor is a brushless motor.

12. The chest compression device of claim 9, further comprising a transmission mechanism for transmission of mechanical energy from the motor to the compression element.

13. The chest compression device of claim 9, wherein the power source comprises at least one high power lithium ion battery or any other battery adapted to supply energy directly to the motor.

14. The chest compression device of claim 9, wherein the power source comprises at least one battery indirectly connected to the motor.

15. The chest compression device of claim 9, wherein the power source is adapted for connection to AC or DC mains.

16. The chest compression device of claim 9, wherein the motor can handle an average power higher than 100 W.

17. The chest compression device of claim 9, wherein the motor has a kinetic energy lower than 4 J at top speed in operation.

18. The chest compression device of claim 9, wherein the motor has a weight lower that 500 grams.

19. The chest compression device of claim 9, wherein the controller is programmed to permit free return of the compression element to an upper position following movement of the compression element to a lower position.

20. The chest compression device of claim 9, wherein the motor is a variable speed motor.

21. The chest compression device of claim 9 wherein the motor has two opposite directions of rotation.

22. The chest compression device of claim 9, wherein the motor is adapted for operation with stationary periods, that is periods with a velocity of 0 RPM.

23. A chest compression device comprising:

a compression element comprising a piston;

a power source;

an electric motor coupled to the compression element to cause translational movement of the piston; and a controller programmed to drive an electric motor according to a drive profile, the drive profile including a compression portion in which the electric motor drives the piston of the compression element to compress a patient's chest, a decompression portion in which the electric motor drives the piston of the compression element away from the patient's chest to allow the chest to decompress, and a wait portion, the decompression portion having a maximum motor speed substantially greater than that of the compression portion.

24. The chest compression device of claim 23, wherein the maximum motor speed of the decompression portion is between about 1.2 and about 1.6 times the maximum motor speed of the compression portion.

25. The chest compression device of claim 24, wherein the maximum motor speed of the decompression portion is about 1.4 times the maximum motor speed of the compression portion.

26. The chest compression device of claim 23, wherein the maximum motor speed of the decompression portion exceeds a typical rate of expansion of the patient's chest following compression.

27. The chest compression device of claim 23, wherein the motor direction during the decompression portion is opposite that of the compression portion.

28. The chest compression device of claim 23, wherein the compression portion comprises an acceleration portion and a deceleration portion, the deceleration portion having a substantially greater duration than the acceleration portion.

29. The chest compression device of claim 23, further comprising a sensor coupled to the electric motor and the controller to sense an operating condition of the electric motor and wherein the controller is programmed to draw the compression element away from the patient's chest upon detecting a signal from the sensor indicating an unsafe operating condition.

30. The chest compression device of claim 26, further comprising an energy storage device coupled to the electric motor and the controller, the controller being programmed to direct power from the energy storage device to the electric motor to draw the compression element away from the patient's chest upon detecting an unsafe operating condition.

31. The chest compression device of claim 27, wherein the unsafe condition is the absence of power from the power source.

* * * * *